US009126062B2

(12) United States Patent
Chabod et al.

(10) Patent No.: US 9,126,062 B2
(45) Date of Patent: Sep. 8, 2015

(54) SAFETY DEVICE ON A ROPE WITH BLOCKING UNDER LOAD

(71) Applicant: ZEDEL, Crolles (FR)

(72) Inventors: Pierre Olivier Chabod, Pontcharra (FR); Christophe Quillard, Eybens (FR); Alain Maurice, Saint Hilaire du Touvet (FR)

(73) Assignee: ZEDEL, Crolles (FR)

( * ) Notice: Subject to any disclaimer, the term of this patent is extended or adjusted under 35 U.S.C. 154(b) by 65 days.

(21) Appl. No.: 14/080,128

(22) Filed: Nov. 14, 2013

(65) Prior Publication Data

US 2014/0138191 A1 May 22, 2014

(30) Foreign Application Priority Data

Nov. 16, 2012 (FR) ..... 12 03082

(51) Int. Cl.
*A62B 1/06* (2006.01)
*A62B 1/14* (2006.01)

(52) U.S. Cl.
CPC .... *A62B 1/06* (2013.01); *A62B 1/14* (2013.01)

(58) Field of Classification Search
CPC ..... A62B 35/04; A62B 1/02; A62B 1/04; A62B 1/06; A62B 1/10; A62B 1/14; A62B 1/20; F16G 11/10; B65H 2701/31; B66D 3/10; A63B 29/02; A63B 2208/12
USPC ..... 188/65.5; 182/5, 191, 192, 193
See application file for complete search history.

(56) References Cited

U.S. PATENT DOCUMENTS

| | | | | |
|---|---|---|---|---|
| 542,641 | A * | 7/1895 | Hembacher | 188/65.5 |
| 5,845,894 | A * | 12/1998 | Petzl et al. | 254/391 |
| 7,845,467 | B2 * | 12/2010 | Petzl et al. | 182/5 |
| 2012/0012800 | A1 | 1/2012 | Chaumontet | |

FOREIGN PATENT DOCUMENTS

| | | | | |
|---|---|---|---|---|
| EP | 0 803 268 | B1 | 1/2003 | |
| EP | 2 407 413 | B1 | 4/2013 | |
| FR | 2 430 388 | | 2/1980 | |
| GB | 2044414 | A * | 10/1980 | A63B 29/00 |

OTHER PUBLICATIONS

English transilation of Description for FR-2430388 (from IDS).*

* cited by examiner

*Primary Examiner* — Anna Momper
*Assistant Examiner* — San Aung
(74) *Attorney, Agent, or Firm* — Oliff PLC

(57) ABSTRACT

A safety device on a rope, comprising a first flange-plate and a movable second flange-plate, a roller mounted on a first spindle integral to the first flange-plate, which presents clearance in the heightwise direction. The movable second flange-plate is equipped:

with a securing notch operating in conjunction with the first spindle to block the device in the closed position when the roller is under load, and with a latch actuated by control means to perform unlatching of the latter enabling opening of the second flange-plate when the device is no longer under load.

9 Claims, 6 Drawing Sheets

SAFETY DEVICE ON A ROPE WITH BLOCKING UNDER LOAD

BACKGROUND OF THE INVENTION

The invention relates to a safety device on a rope, comprising:

- a first flange-plate and a movable second flange-plate delineating a transverse space in which a roller is arranged fitted on a first spindle integral to the first flange-plate,
- and articulation means of the second flange-plate comprising a second spindle allowing a swivelling movement between a closed position clamping the rope in captive manner in the transverse space, and an open position for fitting the rope on the roller.

STATE OF THE ART

A PRO TRAXION progress capture pulley marketed by the applicant is used in mountaineering or in working at heights for hoisting a heavy load. It comprises a pulley mounted rotating freely on a first spindle of a fixed flange-plate and a movable flange-plate articulated around a tubular second spindle offset from the first spindle. A fastening snap-hook passes through the hollow second spindle and an aligned aperture of the first flange-plate in the closed position. The second flange-plate is thus able to be opened without disconnecting the fastening. The rope can be fitted once the pulley has been fastened. A clamping pin or ratchet is designed to latch the second flange-plate in the closed position, but there is nothing to prevent the pin from being unlatched and the second flange-plate from being opened when the pulley is under load.

The documents EP0803268 and EP2407413 refer to pulleys each having a swivelling openable flange-plate and an integrated clamp. The openable flange-plate remains latched in the closed position by the fastening snap-hook. It is impossible to open this flange-plate without removing the snap-hook and disconnecting from the fastening.

The document FR 2430388 describes a descender with self-blocking of the rope, with a relative movement of the movable flange-plate to bring about controlled braking when descending. Moving the movable flange-plate aside remains possible in case of withdrawal of the snap-hook.

Object of the Invention

The object of the invention consists in providing a safety device on a rope, having an opening flange-plate accidental opening of which it is desired to secure under load.

The fall arrest device according to the invention is characterized in that:

- the first flange-plate presents clearance by positioning of the second spindle in an aperture of the first flange-plate, the external diameter of the second spindle being smaller than that of the aperture to define said clearance, and the second flange-plate movable is equipped:
  - with a securing notch operating in conjunction with the first spindle to block the device in the closed position when the roller is under load,
  - and with a latch actuated by control means to perform unlatching of the latter enabling opening of the second flange-plate when the device is no longer under load.

Any involuntary actuation of the control means of the latch makes opening of the second flange-plate impossible, the latter remaining latched in the closed position when the device is under load.

According to a preferred embodiment, the securing notch is in the form of a hook in which the end of the first spindle engages following movement of the second flange-plate to the closed position. A ramp is arranged at the entrance of the notch to perform double blocking of the second flange-plate in conjunction with the latch in the closed position, and in the state with a load on the roller.

When the device is not under load, the movable second flange-plate can be unlatched by making the control means swivel in the unlatching direction of the latch. Movement of the second flange-plate in the opening direction at the beginning of travel causes a reaction of the ramp on the first spindle, resulting in an upward translational movement of the first flange-plate until the clearance is taken up. The notch is then released and escapes from the first spindle enabling total opening of the second flange-plate.

The roller can be fixed or mounted rotating freely on the first spindle. The roller can also be constituted in the form of a free-wheel with unidirectional rotation and blocking in the opposite direction.

The invention apples to any type of safety device on a rope and with an openable flange-plate having to be latched under load, in particular a descender, with a pulley with or without an integrated clamp.

BRIEF DESCRIPTION OF THE DRAWINGS

Other advantages and features will become more clearly apparent from the following description of a particular embodiment of the invention given for non-restrictive example purposes only and represented in the appended drawings, in which.

DESCRIPTION OF A PARTICULAR EMBODIMENT

Figure 1:
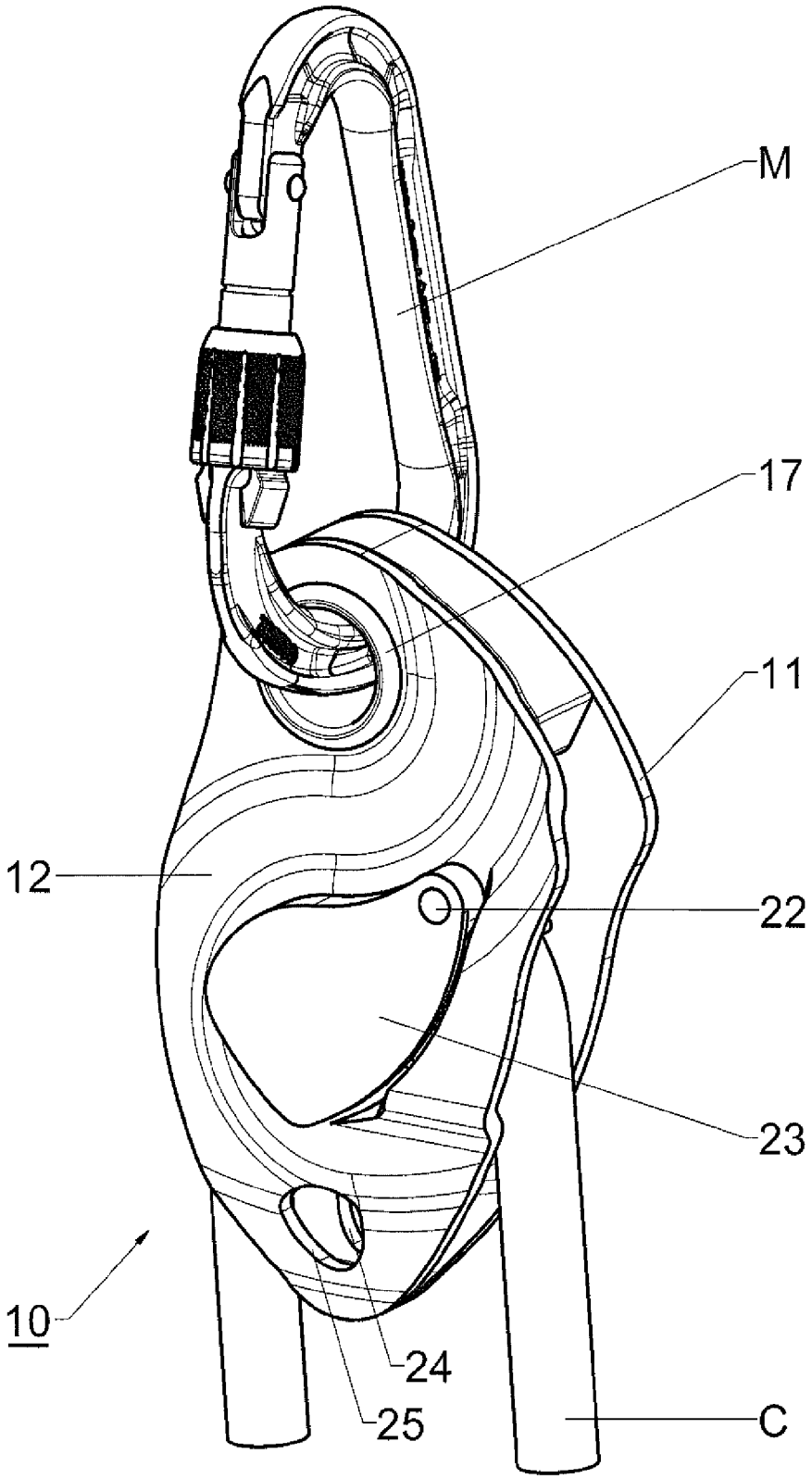
FIG. 1 is a perspective view of the safety device according to the invention, represented in the latched closed position, and in the state where it is under load.

With reference to the figures, a safety device on a rope, designated by the general numeral 10, comprises a first flange-plate 11 and a movable second flange-plate 12 designed to occupy a closed position and an open position. First flange-plate 11 is semi-fixed and is provided with a first spindle 13 on which a roller 14 is mounted provided with an annular groove 15 for guiding of rope C. Roller 14 is mounted rotating freely on first spindle 13 with interposition of a self-lubricating or ball-bearing bushing 16, the assembly forming an openable pulley. The load is applied on roller 14 by means of rope C when second flange-plate 12 is in the closed position.

Roller 14 can also be fixed or be formed by a free-wheel with unidirectional rotation and blocking in the opposite direction. The invention applies to any type of safety device on a rope and with an openable flange-plate, in particular a descender, a pulley, etc. . . .

A second spindle 17 is fixed to the top part of movable second flange-plate 12, this spindle being hollow for passage of an attachment snap-hook M designed to be attached to a fastening. Hollow second spindle 17 is housed with a clearance J in an aperture 18 of first flange-plate 11 and can pivot when second flange-plate 12 is driven to the open position. The diameter of hollow second spindle 17 is smaller than that of aperture 18 to define said translational clearance J of first flange-plate 11 in the heightwise direction. The transverse distance separating the two flange-plates 11, 12 corresponds appreciably to the length of second spindle 17. The presence of clearance J makes first flange-plate 11 semi-fixed.

According to an alternative embodiment, second spindle 17 can be solid.

The inner surface of movable second flange-plate 12 is provided with a securing notch 19 in the form of a hook in which the end of first spindle 13 can engage when second flange-plate 12 moves to the closed position. This notch 19 is provided with a ramp 20 causing blocking in the closed position when roller 14 or pulley is under load. A latch 21 pivoting on a spindle 22 is biased by a bias spring (not shown) to a blocking position to latch second flange-plate 12 positively in the closed position.

The front surface of second flange-plate 12 is equipped with control means 23 coupled to latch 21 to perform unlatching of the latter enabling opening of second flange-plate 12 when the device is no longer under load.

Each flange-plate 11, 12 comprises a hole 24, 25 in the bottom part, said holes being aligned in the closed position and enabling an additional snap-hook to be attached to padlock the device in the closed position.

Figure 3:
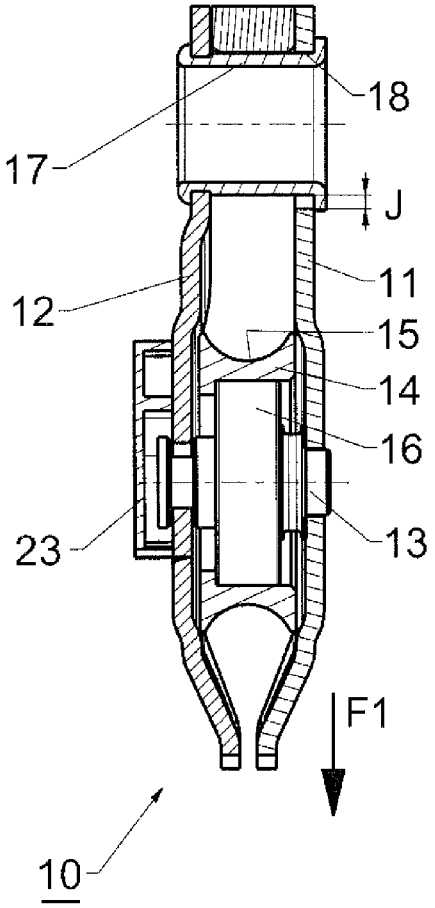
FIG. 3 is a cross-sectional view along the line 3-3 of FIG. 2, showing the clearance J between the hollow second spindle and the first flange-plate.
Figure 2:
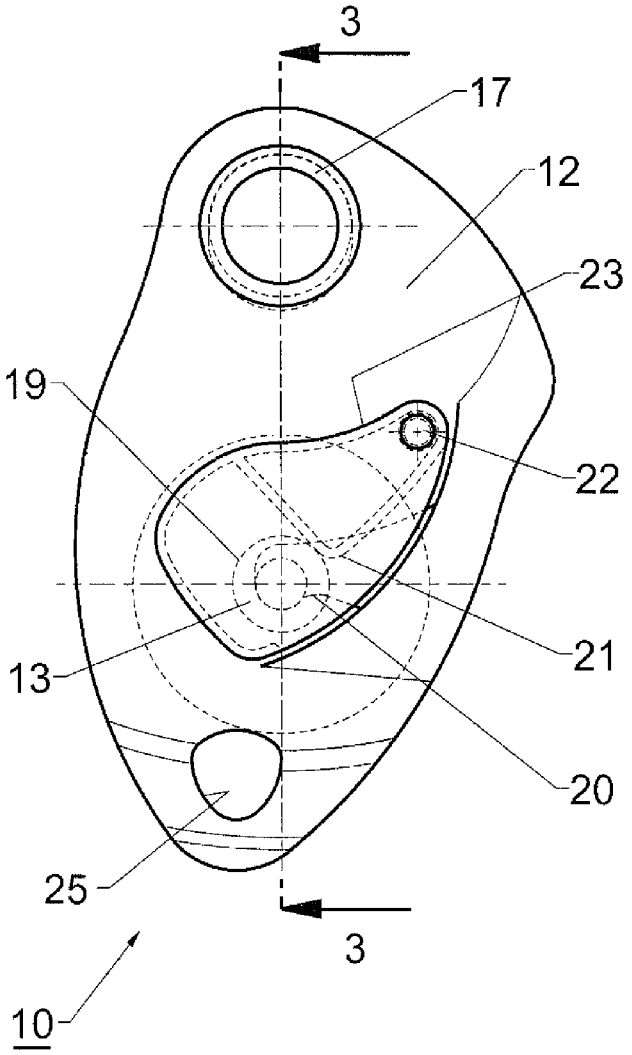
FIG. 2 shows an elevational view of the device of FIG. 1, the fastening snap-hook having been removed.

Operation of safety device 10 with openable pulley according to the invention is as follows:

In FIGS. 1 to 3, the device is under load and the second flange-plate is in the closed position, latched both by latch 21 and ramp 20 and by application of the load on roller 14. First flange-plate 11 is pulled downwards (arrow F1, FIG. 3), and presses on the top of second spindle 17. Clearance J is located between the bottom of aperture 18 of first flange-plate 11 and hollow second spindle 17. First spindle 13 is located at the bottom of notch 19 and blocks second flange-plate 12 in the closed position. Any involuntary actuation of control means 23 of latch 21 makes opening of second flange-plate 12 impossible when the device is under load.

Figure 5:
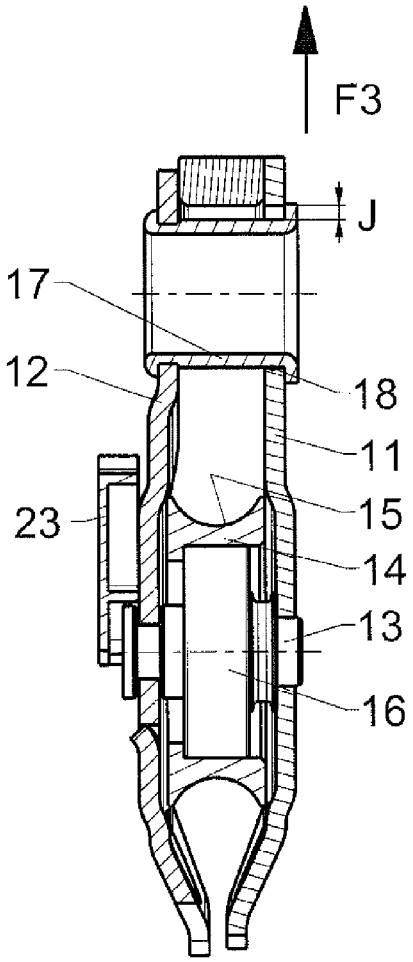
FIGS. 4 and 5 are identical views to FIGS. 2 and 3, the device no longer being under load, and the control means having unlatched the latch enabling a reaction of the ramp on the first spindle at the beginning of manual opening of the second flange-plate resulting in the clearance J of the first flange-plate being taken up.
Figure 4:
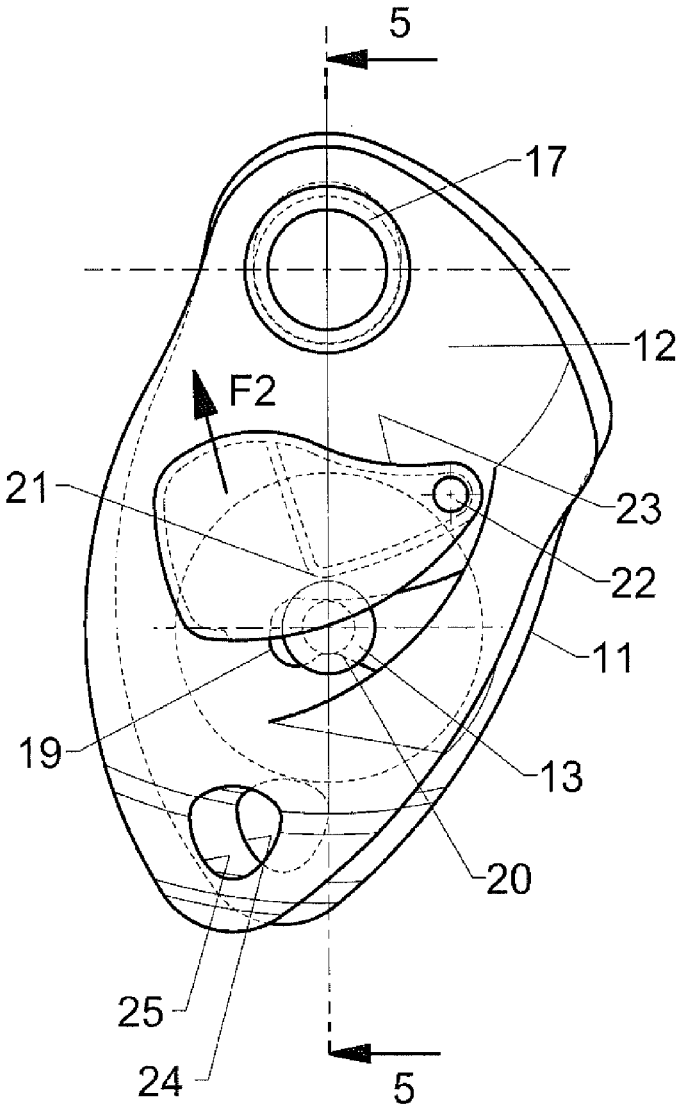

With reference to FIGS. 4 and 5, the device is no longer under load and it is then possible to unlatch second flange-plate 12 making control means 23 pivot in the unlocking direction indicated by arrow F2. Latch 21 is unlatched and movement of second flange-plate 12 in the opening direction causes a reaction of ramp 20 on first spindle 13 at the beginning of travel, resulting in a slight upwards translational movement of first flange-plate 11 (arrow F3, FIG. 5) until clearance J is taken up. Notch 19 is released from the securing of first spindle 13.

Figure 7:
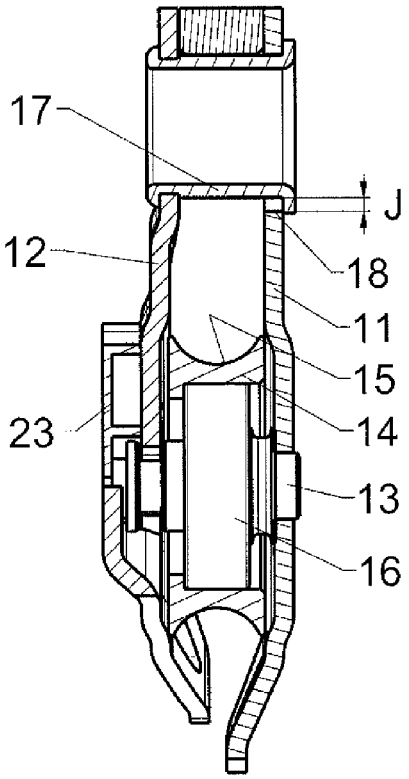
FIGS. 6 and 7 are identical views to FIGS. 4 and 5 on continuation of opening of the second flange-plate and escape of the first spindle from the securing notch.
Figure 6:
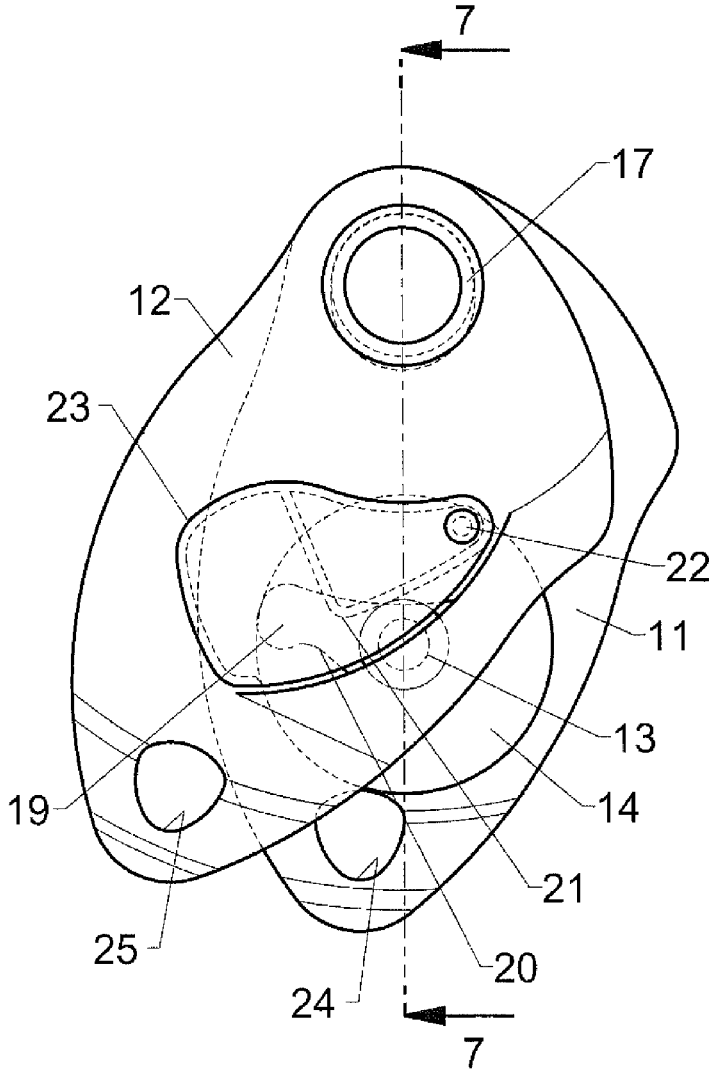

In FIGS. 6 and 7, the manual opening movement of second flange-plate 12 can be continued after control means 23 have been released. Ramp 20 is no longer in contact with first spindle 13 and first flange-plate 11 returns to the initial position pressing on hollow second spindle 17. The maximum opening position of second flange-plate 12 enables rope C to be wound around roller 14, the device remaining connected to the fastening.

The device with openable flange-plate described in the foregoing FIGS. 1 to 7 can be equipped with an integrated clamp of well-known type, in particular that of document EP 0803268.

Figure 8:
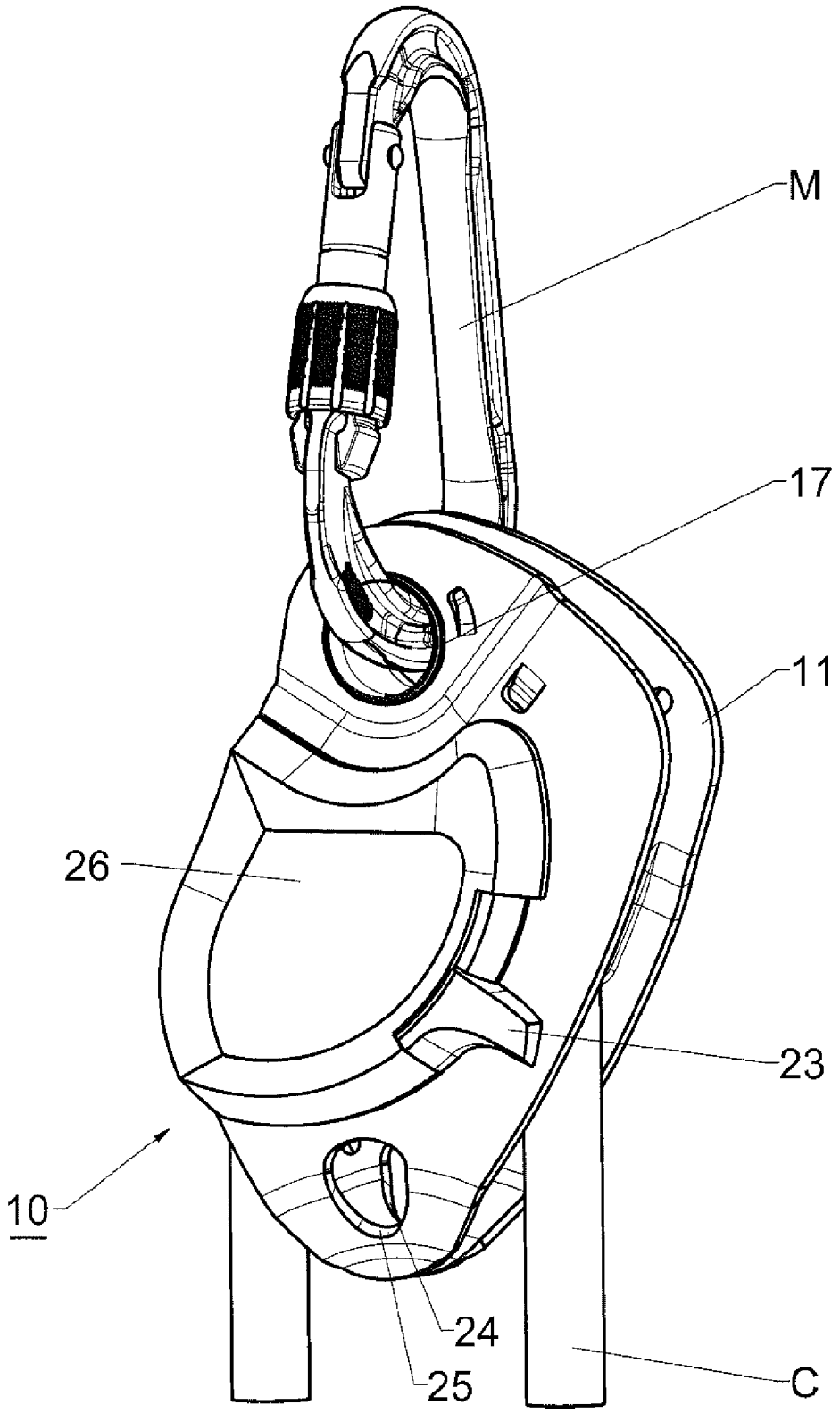
FIG. 8 shows an alternative embodiment of FIG. 1, with a reverse opening.
Figure 10:
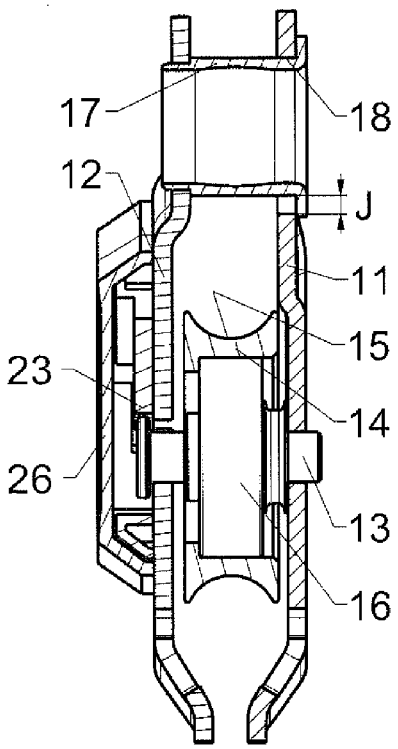
FIG. 10 is a cross-sectional view along the line 9-9 of FIG. 8 showing the clearance J between the hollow second spindle and the first flange-plate.
Figure 9:
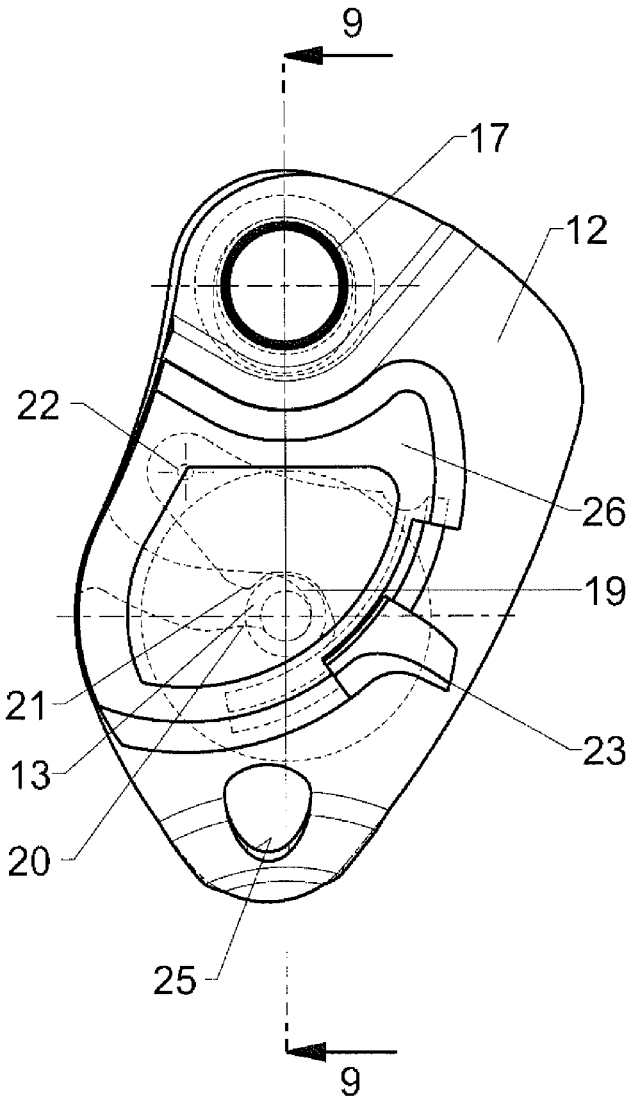
FIG. 9 shows an elevational view of the device of FIG. 8, the fastening snap-hook having been removed.

On the alternative embodiment of FIGS. 8 to 10, the same reference numerals are used to designate similar parts. Control means 23 are formed by a handle pivoting in the counterclockwise direction. These control means are protected underneath a cache 26. Second flange-plate 12 is similar to that of FIGS. 1 to 7 and operates in conjunction with the same hollow second spindle 17 so as to present clearance J. Second flange-plate 12 also comprises the securing notch with ramp 20 and latch 21, but opens in the opposite direction to that of the device of FIGS. 1 to 7.

The concept of the invention can also be applied to a descender or any other belaying device on a rope, having an openable flange-plate, accidental opening of which under load is to be secured.

The invention claimed is:

1. A safety device on a rope, comprising:

a first flange-plate and a movable second flange-plate delineating a transverse space in which a roller is arranged fitted on a first spindle integral to the first flange-plate, articulation means of the second flange-plate comprising a second spindle allowing a swivelling movement between a closed position clamping the rope in captive manner in the transverse space, and an open position for fitting the rope on the roller, wherein:

the first flange-plate presents clearance by positioning of the second spindle in an aperture of the first flange-plate, the external diameter of the second spindle being smaller than that of the aperture to define said clearance, which is arranged to allow a translational movement of the first flange-plate between a first position where the roller is unloaded, and a second position where the roller is under load, and the movable second flange-plate is equipped:

with a securing notch in which the first spindle engages following a swivelling movement of the second flange-plate to the closed position, so as to block the device in the closed position when the roller is under load in the second position, and with a latch actuated by control means to perform unlatching of the latter enabling opening of the second flange-plate when the device is unloaded in the first position.

2. The safety device according to claim 1, wherein the second spindle of the second flange-plate is hollow.

3. The safety device according to claim 1, wherein the securing notch is in the form of a hook.

4. The safety device according to claim 3, wherein the notch is provided with a ramp operating in conjunction with the latch to cause double blocking of the second flange-plate in the closed position, and in the loaded state on the roller.

5. The safety device according to claim 4, wherein the ramp is arranged to move the first flange-plate until said clearance is taken up when the device is no longer under load, said movement of the first flange-plate being derived from a manual opening movement of the second flange-plate, after the latch has been unlatched by the control means.

6. The safety device according to claim 1, wherein the roller is mounted fixed on the first spindle of the first flange-plate.

7. The safety device according to claim 1, wherein the roller is in the form of a rotary pulley mounted idle on the first spindle.

8. The safety device according to claim 7, wherein the pulley is associated with a clamping trigger designed to clamp the rope against the roller.

9. The safety device according to claim 1, wherein the roller is formed by a free-wheel with unidirectional rotation and blocking in the opposite direction.

* * * * *